US009754541B2

(12) United States Patent
Takasaki et al.

(10) Patent No.: US 9,754,541 B2
(45) Date of Patent: Sep. 5, 2017

(54) DISPLAY DEVICE AND DISPLAY DEVICE DRIVE METHOD

(71) Applicant: Japan Display Inc., Tokyo (JP)

(72) Inventors: Naoyuki Takasaki, Tokyo (JP); Tsutomu Harada, Tokyo (JP); Fumitaka Gotoh, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 14/731,038

(22) Filed: Jun. 4, 2015

(65) Prior Publication Data

US 2015/0364094 A1 Dec. 17, 2015

(30) Foreign Application Priority Data

Jun. 16, 2014 (JP) ..... 2014-123066

(51) Int. Cl.

| | |
|---|---|
| ***G09G 3/34*** | (2006.01) |
| ***G09G 3/36*** | (2006.01) |
| ***G09G 3/20*** | (2006.01) |

(52) U.S. Cl.

CPC ..... *G09G 3/342* (2013.01); *G09G 3/2096* (2013.01); *G09G 3/3607* (2013.01); *G09G 2300/0452* (2013.01); *G09G 2320/064* (2013.01); *G09G 2320/0646* (2013.01); *G09G 2320/103* (2013.01); *G09G 2340/06* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 2004/0119995 | A1* | 6/2004 | Nishi | H04N 1/6027 358/1.9 |
| 2009/0244112 | A1* | 10/2009 | Jung | G09G 3/3406 345/691 |
| 2010/0103089 | A1* | 4/2010 | Yoshida | G09G 3/2022 345/102 |
| 2010/0295767 | A1* | 11/2010 | Lee | G09G 3/3426 345/102 |

(Continued)

FOREIGN PATENT DOCUMENTS

| | | |
|---|---|---|
| JP | 2011-248352 A | 12/2011 |
| JP | 2013-062070 A | 4/2013 |

(Continued)

*Primary Examiner* — Aaron M Richer

(74) *Attorney, Agent, or Firm* — Michael Best & Friedrich LLP

(57) ABSTRACT

A display device includes an image display panel section which displays an image on the basis of an image signal, a light source section which emits light to the image display panel section by dimming control according to a control signal based on the image signal, and a control section which determines on the basis of the image signal from a mode of change in light emission luminance of the light source section whether the image displayed by the image display panel section is a dynamic image or a static image and which performs switching according to a determination result between a static image control speed and a dynamic image control speed of the dimming control. The display device suppresses image quality degradation caused at the time of displaying a dynamic image or a static image.

8 Claims, 12 Drawing Sheets

(56) References Cited

U.S. PATENT DOCUMENTS

| | | | | |
|---|---|---|---|---|
| 2011/0267381 | A1 | 11/2011 | Yamazaki et al. | |
| 2013/0106895 | A1* | 5/2013 | Jeong | G09G 3/3648 345/589 |
| 2014/0198123 | A1 | 7/2014 | Shibamiya et al. | |
| 2014/0267471 | A1 | 9/2014 | Harada et al. | |

FOREIGN PATENT DOCUMENTS

| | | | |
|---|---|---|---|
| JP | 2013-068937 | A | 4/2013 |
| JP | 2014-178369 | A | 9/2014 |

* cited by examiner

| FRAME NUMBER | 1 | 2 | 3 | 4 | 5 |
|---|---|---|---|---|---|
| PWM VALUE | 192 | 192 | 192 | 192 | 192 |

| FRAME NUMBER | 1 | 2 | 3 | 4 | 5 |
|---|---|---|---|---|---|
| PWM VALUE | 80 | 64 | 128 | 120 | 155 |

DISPLAY DEVICE AND DISPLAY DEVICE DRIVE METHOD

CROSS-REFERENCE TO RELATED APPLICATION

This application is based upon and claims the benefit of priority of the prior Japanese Patent Application No. 2014-123066, filed on Jun. 16, 2014, the entire contents of which are incorporated herein by reference.

FIELD

The embodiments discussed herein are related to a display device and a display device drive method.

BACKGROUND

A display device which reduces power consumption by controlling the luminance of a backlight according to an input image signal and which improves display quality at the time of displaying a dynamic image and a static image is proposed (see, for example, Japanese Laid-open Patent Publication No. 2011-248352).

SUMMARY

There are provided a display device and a display device drive method which further suppress image quality degradation.

According to an aspect, there is provided a display device including an image display panel section which displays an image on the basis of an image signal, a light source section which emits light to the image display panel section by dimming control according to a control signal based on the image signal, and a control section which determines on the basis of the image signal from a mode of change in light emission luminance of the light source section whether the image displayed by the image display panel section is a dynamic image or a static image and which performs switching according to a determination result between a static image control speed and a dynamic image control speed of the dimming control.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Figure 1:
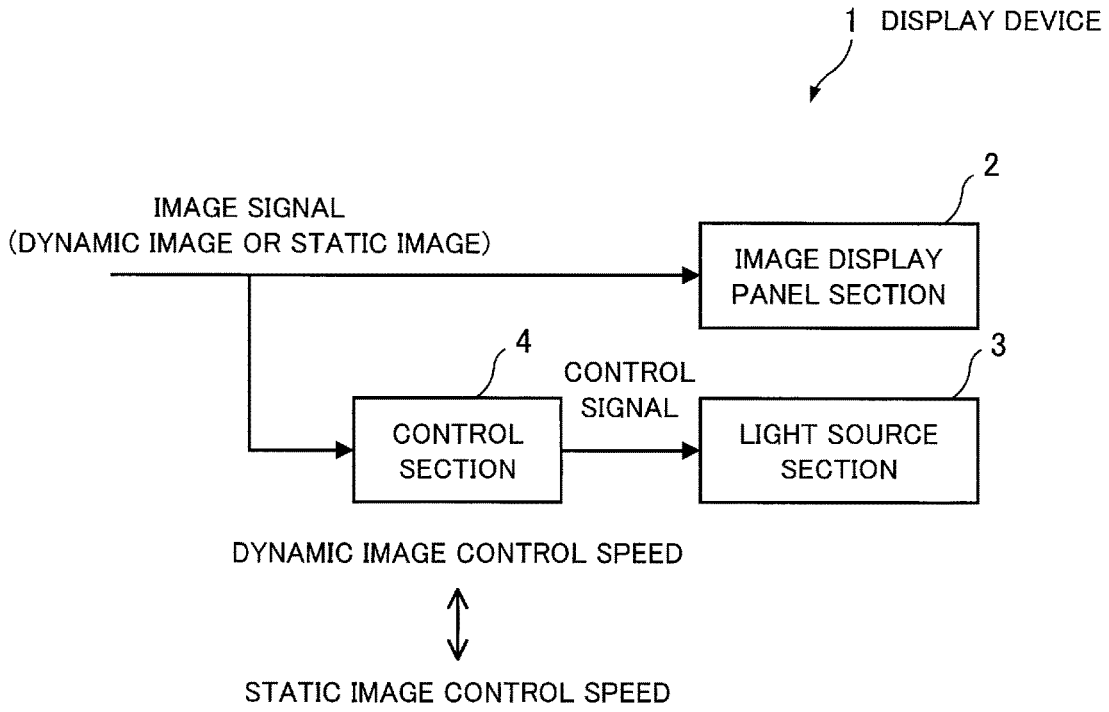
FIG. 1 illustrates an example of the structure of a display device according to a first embodiment.

Embodiments will now be described with reference to the accompanying drawings, wherein like reference numerals refer to like elements throughout.

Disclosed embodiments are just examples. It is a matter of course that a proper change which suits the spirit of the invention and which will readily occur to those skilled in the art falls within the scope of the present invention. Furthermore, in order to make description clearer, the width, thickness, shape, or the like of each component may schematically be illustrated in the drawings compared with the real state. However, it is a simple example and the interpretation of the present invention is not restricted.

In addition, in the present invention and the drawings the same components that have already been described in previous drawings are marked with the same numerals and detailed descriptions of them may be omitted according to circumstances.

First Embodiment

A display device according to a first embodiment will be described by the use of FIG. 1.

FIG. 1 illustrates an example of the structure of a display device according to a first embodiment.

A display device 1 includes an image display panel section 2, a light source section 3, and a control section 4.

The image display panel section 2 displays an image on the basis of an image signal.

The light source section 3 emits light to the image display panel section 2 by dimming control according to a control signal based on the image signal. Furthermore, the light source section 3 which emits light in this way lights the image display panel section 2 from its rear or front.

If an image displayed in this way by the image display panel section 2 is a dynamic image, then the light source section 3 makes its light emission luminance change with a change in displayed image. If at this time the timing at which the light emission luminance of the light source section 3 changes deviates from the timing at which an image changes, then there appears an area on an image displayed by the display device 1 in which luminance suddenly changes. In addition, if the displayed image is a static image, particularly if a dynamic image changes to a static image, a change in the light emission luminance of the light source section 3 may lag behind a change in image. As a result, the displayed image appears to wave.

Accordingly, the display device 1 further includes the control section 4 which exercises the following control. The control section 4 determines on the basis of the image signal from a mode of change in the light emission luminance of the light source section 3 whether an image displayed by the image display panel section 2 is a dynamic image or a static image. For example, if the image displayed by the image display panel section 2 is a dynamic image, then the light emission luminance of the light source section 3 changes with the passage of time. Accordingly, when the control section 4 specifies that the light emission luminance of the light source section 3 changes, then the control section 4 determines that the image displayed by the image display panel section 2 is a dynamic image. On the other hand, if the image displayed by the image display panel section 2 is a static image, then the light emission luminance of the light source section 3 does not change and is constant. Therefore, when the control section 4 specifies that the light emission luminance of the light source section 3 does not change, then the control section 4 determines that the image displayed by the image display panel section 2 is a static image. The control section 4 performs switching between a static image control speed and a dynamic image control speed of dimming control according to a result of the determination made in this way. In this embodiment the static image control speed means the switching speed of the light source section 3 at the time of a change of display from a static image to another static image. Furthermore, the dynamic image control speed means the switching speed of the light source section 3 at the time of the display of a dynamic image.

A display method by the display device 1 having the above structure will be described.

When an image signal is inputted to the display device 1, the light source section 3 emits light by dimming control according to a control signal based on the image signal. The image display panel section 2 lit by the light source section 3 displays an image based on the image signal.

The control section 4 specifies a mode of change in the light emission luminance of the light source section 3 on the basis of the image signal. If the light emission luminance of the light source section 3 changes, then the control section 4 determines that the displayed image is a dynamic image, and performs switching from the static image control speed of dimming control by the light source section 3 to the dynamic image control speed which is lower than the static image control speed. In this case, the dynamic image control speed is lower than the static image control speed, so the speed at which the light emission luminance of the light source section 3 is controlled by dimming control is low. This suppresses a sudden change in luminance in an image displayed by the display device 1.

Furthermore, if the light emission luminance of the light source section 3 does not change, then the control section 4 determines that the displayed image is a static image, and performs switching from the dynamic image control speed of dimming control by the light source section 3 to the static image control speed which is higher than the dynamic image control speed. In this case, the static image control speed is higher than the dynamic image control speed. In particular, when an image displayed by the display device 1 changes from a dynamic image to a static image, a delay in a change in the light emission luminance of the light source section 3 is suppressed. This makes it possible to prevent an image displayed by the display device 1 from waving.

The above display device 1 includes the image display panel section 2 which displays an image on the basis of an image signal, the light source section 3 which emits light to the image display panel section 2 by dimming control according to a control signal based on the image signal, and the control section 4. The control section 4 determines on the basis of the image signal from a mode of change in the light emission luminance of the light source section 3 whether an image displayed by the image display panel section 2 is a dynamic image or a static image, and performs switching between the static image control speed and the dynamic image control speed of dimming control according to a determination result. Accordingly, the display device 1 suppresses image quality degradation caused at the time of displaying a dynamic image or a static image.

Second Embodiment

Next, in a second embodiment the display device 1 according to the first embodiment will be described more concretely.

First an example of the hardware configuration of a display device according to a second embodiment will be described by the use of FIG. 2.

Figure 2:
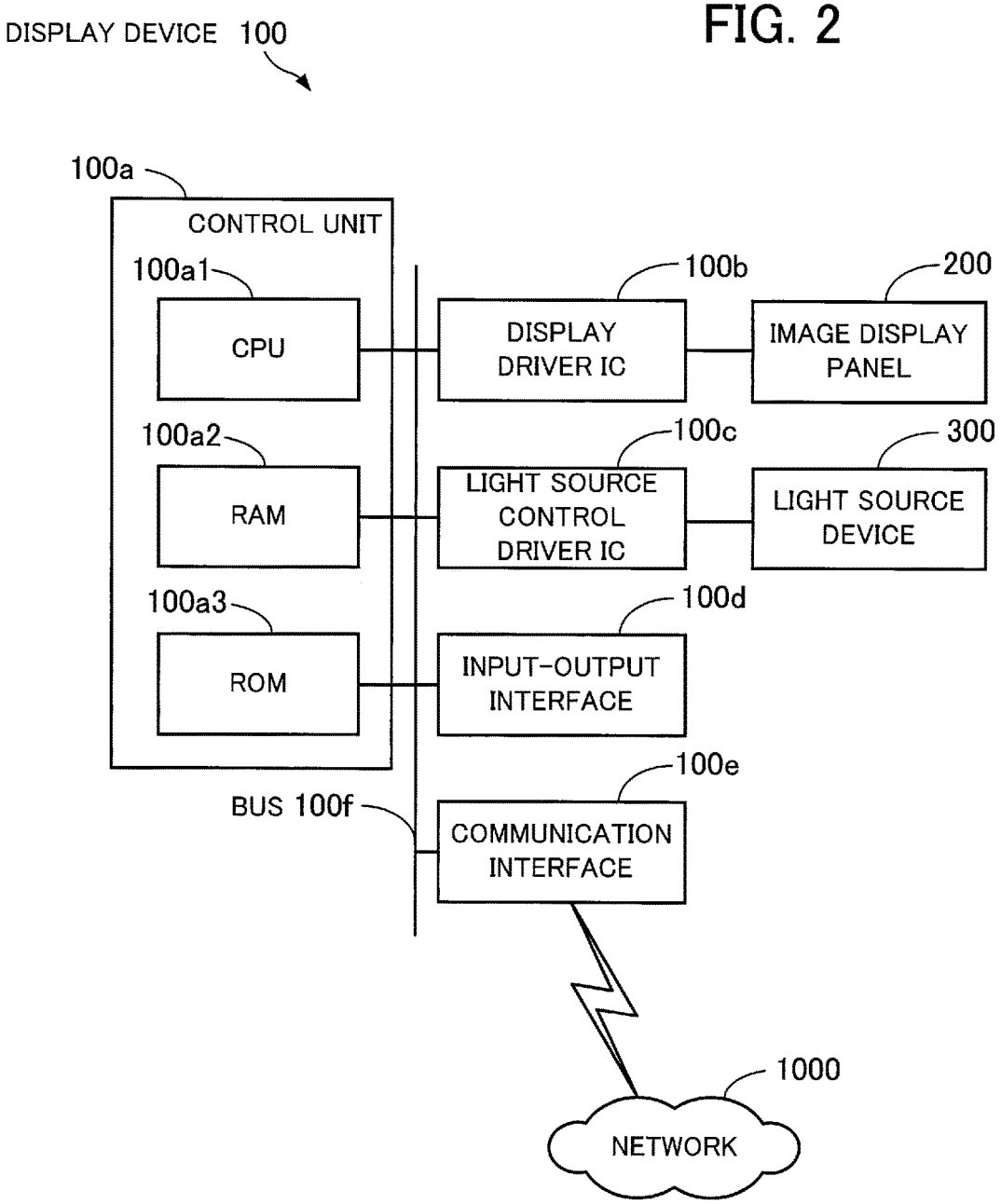
FIG. 2 illustrates an example of the hardware configuration of a display device according to a second embodiment.

FIG. 2 illustrates an example of the hardware configuration of a display device according to a second embodiment.

A display device 100 is an embodiment of the display device 1 illustrated in FIG. 1 and the whole of the display device 100 is controlled by a control unit 100*a*.

The control unit 100*a* includes a central processing unit (CPU) 100*a*1. A random access memory (RAM) 100*a*2, a read only memory (ROM) 100*a*3, and a plurality of peripheral units are connected to the CPU 100*a*1 via a bus 100*f* so as to input or output a signal between them.

The CPU 100*a*1 controls the whole of the display device 100 on the basis of an operating system (OS) program and application programs stored in the ROM 100*a*3 and various pieces of data expanded in the RAM 100*a*2. When the CPU 100*a*1 performs a process, the CPU 100*a*1 may operate on the basis of the OS program and an application program temporarily stored in the RAM 100*a*2.

The RAM 100*a*2 is used as main storage of the control unit 100*a*. The RAM 102*a*2 temporarily stores at least a part of the OS program or an application program executed by the CPU 100*a*1. In addition, the RAM 100*a*2 stores various pieces of data which the CPU 100*a*1 needs to perform a process.

The ROM 100*a*3 is a read only semiconductor memory and stores the OS program, the application programs, and fixed data which is not rewritten. Furthermore, a semiconductor memory, such as a flash memory, may be used as auxiliary storage in place of the ROM 100*a*3 or in addition to the ROM 100*a*3.

The plurality of peripheral units connected to the bus 100*f* are a display driver integrated circuit (IC) 100*b*, a light source control driver IC 100*c*, an input-output interface 100*d*, and a communication interface 100*e*.

An image display panel 200 is connected to the display driver IC 100*b*. The display driver IC 100*b* outputs an output signal to the image display panel 200 to display an image on the image display panel 200. The display driver IC 100*b* may realize at least a part of the functions of an image display panel drive section described later.

A light source device 300 is connected to the light source control driver IC 100*c*. The light source control driver IC

100*c* drives a light source according to a light source control signal and controls the luminance of the light source device 300. The light source control driver IC 100*c* realizes at least a part of the functions of a light source device drive section described later.

An input device used for inputting a user's instructions is connected to the input-output interface 100*d*. An input device, such as a keyboard, a mouse used as a pointing device, or a touch panel, is connected. The input-output interface 100*d* transmits to the CPU 100*a*1 a signal transmitted from the input device, and transmits to the input device a signal transmitted from the CPU 100*a*1.

The communication interface 100*e* is connected to a network 1000. The communication interface 100*e* transmits data to or receives data from another computer or a communication apparatus via the network 1000.

By adopting the above hardware configuration, the processing functions in the second embodiment are realized.

An example of the structure of the image display panel 200 will now be described by the use of FIG. 3.

Figure 3:
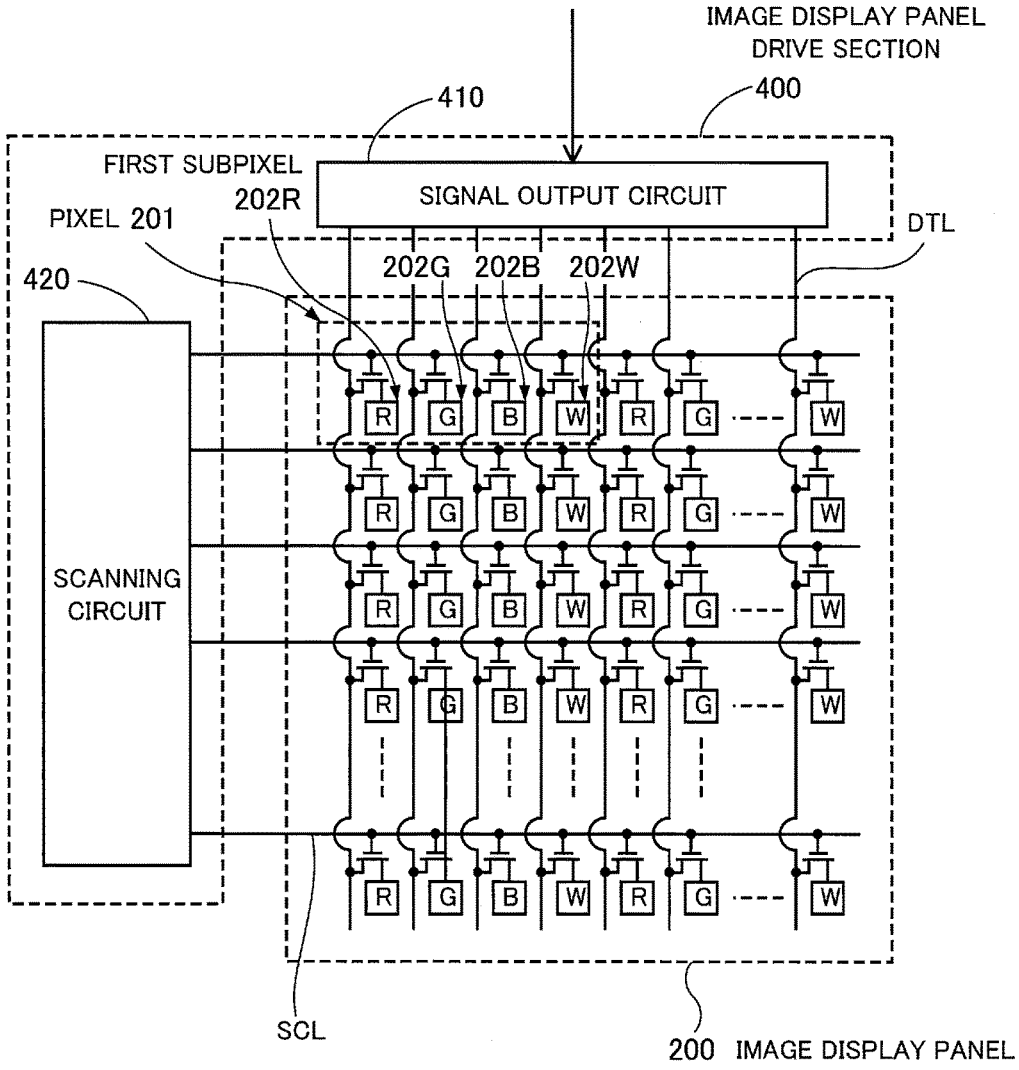
FIG. 3 illustrates an example of the structure of an image display panel included in the display device according to the second embodiment.

FIG. 3 illustrates an example of the structure of the image display panel included in the display device according to the second embodiment.

With the image display panel 200 each of pixels 201 arranged like a two-dimensional matrix includes a first subpixel 202R, a second subpixel 202G, a third subpixel 202B, and a fourth subpixel 202W. The first subpixel 202R displays red, the second subpixel 202G displays green, the third subpixel 202B displays blue, and the fourth subpixel 202W displays white. However, colors which the first subpixel 202R, the second subpixel 202G, and the third subpixel 202B display are not limited to them. The first subpixel 202R, the second subpixel 202G, and the third subpixel 202B may display other different colors. For example, the first subpixel 202R, the second subpixel 202G, and the third subpixel 202B may display the complementary colors of red, green, and blue respectively. Furthermore, a color which the fourth subpixel 202W displays is not limited to white. For example, the fourth subpixel 202W may display yellow. However, white is effective in reducing power consumption. It is desirable that if the first subpixel 202R, the second subpixel 202G, the third subpixel 202B, and the fourth subpixel 202W are lighted at the same light source lighting amount, the fourth subpixel 202W be brighter than the first subpixel 202R, the second subpixel 202G, and the third subpixel 202B. If there is no need to distinguish among the first subpixel 202R, the second subpixel 202G, the third subpixel 202B, and the fourth subpixel 202W, then the term "subpixels 202" will be employed in the following description.

More specifically, the image display panel 200 is a transmission type color liquid crystal display panel. Color filters which transmits red light, green light, and blue light are disposed between the first subpixel 202R, the second subpixel 202G, and the third subpixel 202B, respectively, and an observer of an image. Furthermore, a color filter is not disposed between the fourth subpixel 202W and an observer of an image. The fourth subpixel 202W may include a transparent resin layer in place of a color filter. If a color filter is not disposed between the fourth subpixel 202W and an observer of an image, a great difference in level arises between the fourth subpixel 202W and the first subpixel 202R, the second subpixel 202G, and the third subpixel 202B. The formation of a transparent resin layer prevents a great difference in level from arising between the fourth subpixel 202W and the first subpixel 202R, the second subpixel 202G, and the third subpixel 202B.

A signal output circuit 410 and a scanning circuit 420 included in an image display panel drive section 400 are electrically connected to the first subpixels 202R, the second subpixels 202G, the third subpixels 202B, and the fourth subpixels 202W of the image display panel 200 via signal lines DTL and scanning lines SCL respectively. The subpixels 202 are connected not only to the signal lines DTL but also to the scanning lines SCL via switching elements (such as thin film transistors (TFTs)). The image display panel drive section 400 selects subpixels 202 by the scanning circuit 420 and outputs image signals in order from the signal output circuit 410. By doing so, the image display panel drive section 400 controls the operation (light transmittance) of the subpixels 202.

An example of the structure of the light source device 300 will now be described by the use of FIG. 4.

Figure 4:
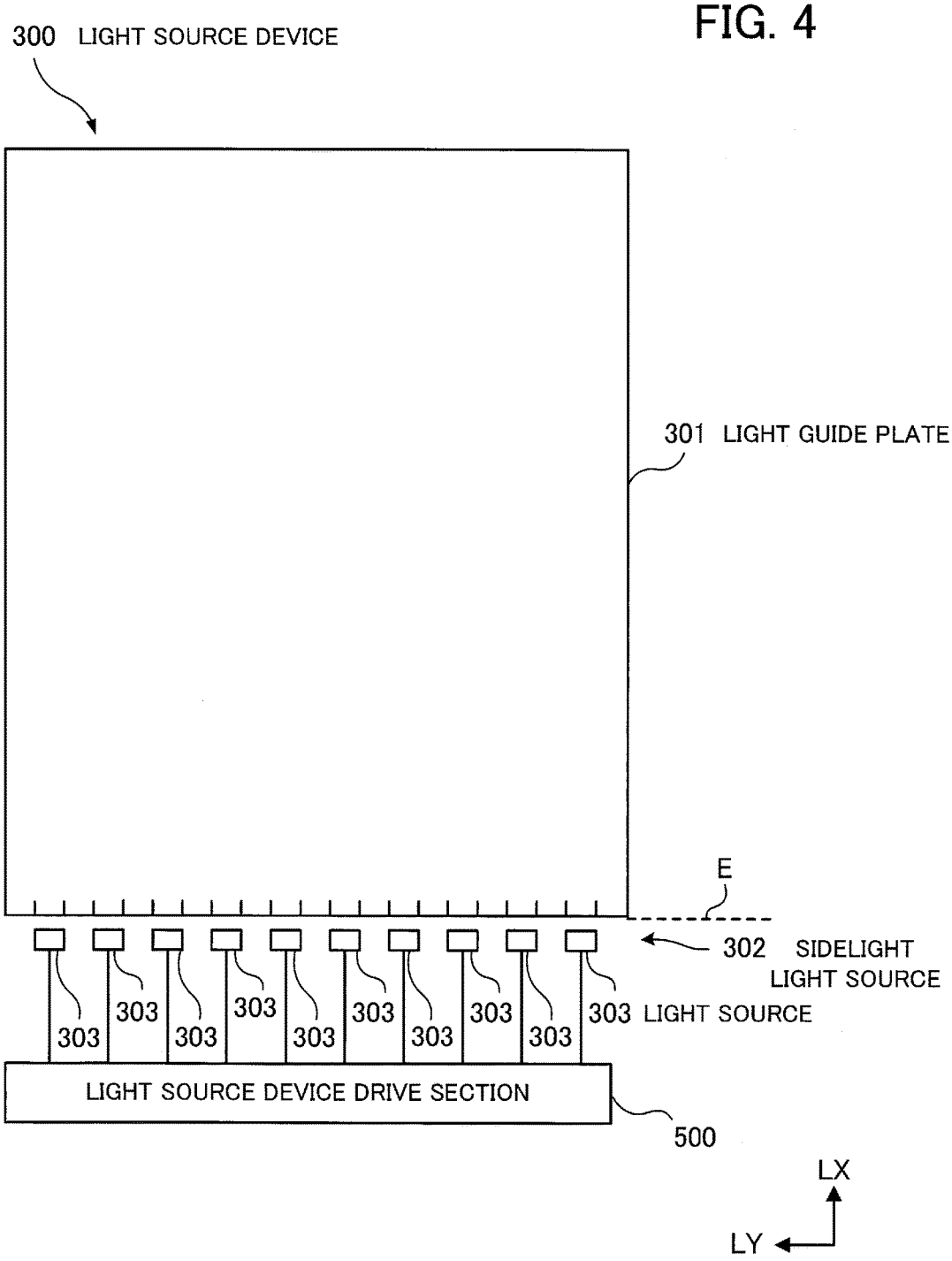
FIG. 4 illustrates an example of the structure of a light source device in the second embodiment.

FIG. 4 illustrates an example of the structure of the light source device in the second embodiment.

The light source device 300 includes a light guide plate 301 and a sidelight light source 302 in which a plurality of light sources 303 are arranged opposite an incident surface E that is at least one side of the light guide plate 301. The plurality of light sources 303 are light-emitting diodes (LEDs) which emit light of the same color (white, for example), and control light emission signals (such as current values or pulse width modulation (PWM) values (duty ratios, for example)) independently of one another. The light sources 303 are arranged along the one side of the light guide plate 301. It is assumed that the direction in which the light sources 303 are arranged is a light source arrangement direction LY. Light emitted from the light sources 303 is inputted from the incident surface E to the light guide plate 301 in an incident direction LX perpendicular to the light source arrangement direction LY. For example, a surface light source device in which the above light-emitting diodes are used as light sources may be used as the light source device 300.

A light source device drive section 500 adjusts a light emission signal to be supplied to each light source 303 on the basis of a light source control signal described later. By doing so, the light source device drive section 500 controls the amount of the light of each light source 303 and controls (dimming-controls) the luminance (intensity of the light) of the light source device 300. Furthermore, the light source device drive section 500 exercises the above control according to the light sources 303. This division drive (local dimming) control makes it possible to control the contrasts of different areas on the same light emission surface of the light source device 300.

An example of the structure of the functions of the display device 100 having the above structure will now be described by the use of FIG. 5.

Figure 5:
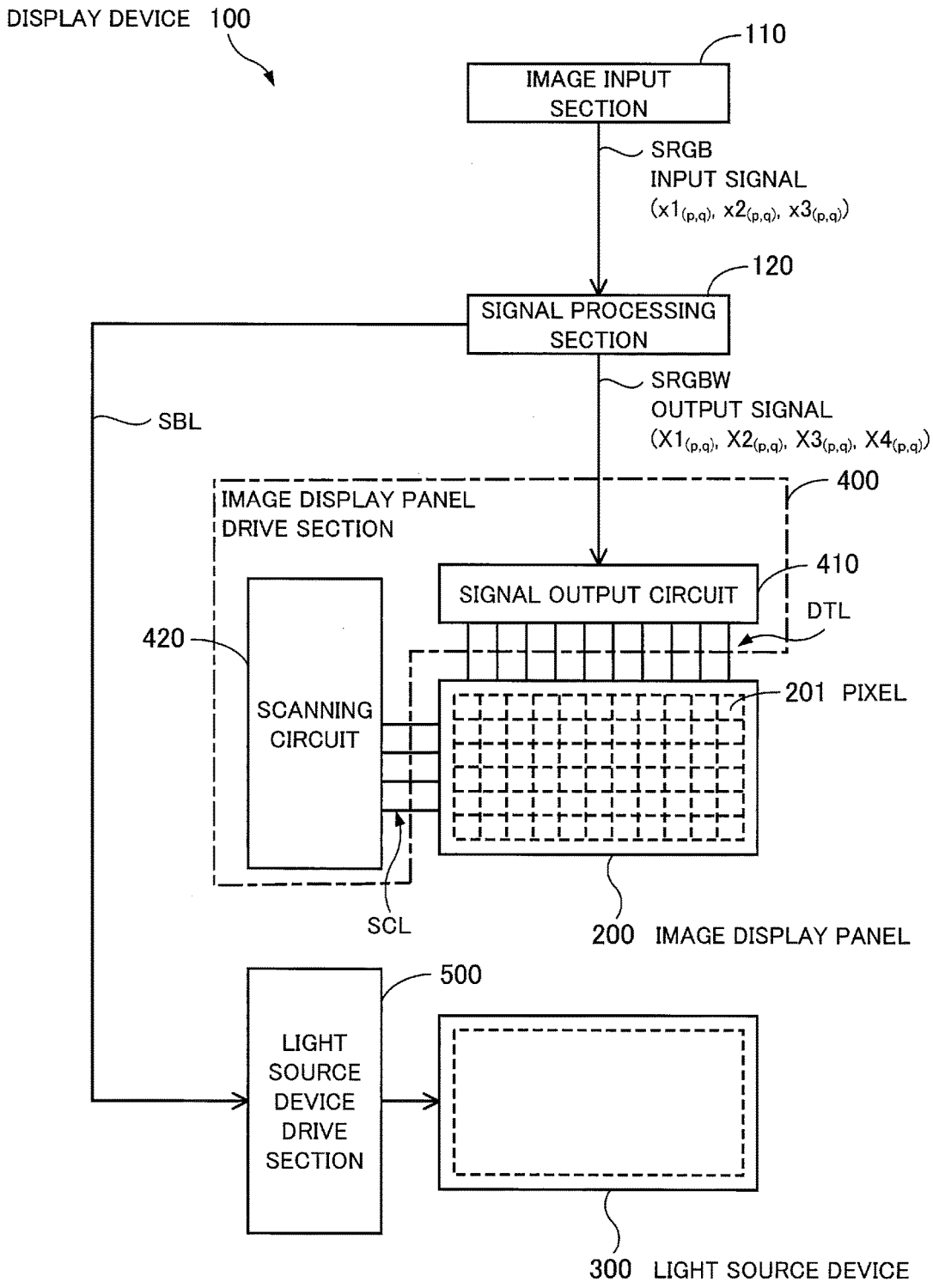
FIG. 5 illustrates an example of the structure of the functions of the display device according to the second embodiment.

FIG. 5 illustrates an example of the structure of the functions of the display device according to the second embodiment.

The display device 100 includes an image input section 110, a signal processing section 120, the image display panel 200, the light source device 300, the image display panel drive section 400, and the light source device drive section 500.

The image input section 110 inputs an input signal SRGB to the signal processing section 120. The input signal SRGB includes an input signal value $\mathbf{x1}_{(p,q)}$ for a first primary color, an input signal value $\mathbf{x2}_{(p,q)}$ for a second primary color, and an input signal value $\mathbf{x3}_{(p,q)}$ for a third primary color. In the second embodiment it is assumed that the first primary color is red, that the second primary color is green, and that the third primary color is blue.

The signal processing section 120 is connected to the image display panel drive section 400 which drives the image display panel 200 and is connected to the light source device drive section 500 which drives the light source device 300. The signal processing section 120 division-controls the luminance of the light source device 300 by blocks. Furthermore, the signal processing section 120 calculates luminance information regarding luminance values of the entire surface of the light source device 300 on the basis of the input signal SRGB, makes an output signal SRGBW reflect the calculated luminance information, and makes the light source device drive section 500 display an image. In addition to an output signal value $X1_{(p,q)}$ corresponding to a first subpixel, an output signal value $X2_{(p,q)}$ corresponding to a second subpixel, and an output signal value $X3_{(p,q)}$ corresponding to a third subpixel, the output signal SRGBW includes an output signal value $X4_{(p,q)}$ corresponding to a fourth subpixel which displays a fourth color. In the second embodiment it is assumed that the fourth color is white. The signal processing section 120 is an embodiment of the control section 4 in the first embodiment.

The image display panel 200 is made up of the (P×Q) pixels 201 arranged like a two-dimensional matrix.

The image display panel drive section 400 includes the signal output circuit 410 and the scanning circuit 420 and drives the image display panel 200. The image display panel 200 and the image display panel drive section 400 are an embodiment of the image display panel section 2.

The light source device 300 is arranged on a rear side of the image display panel 200 and emits light to the image display panel 200. By doing so, the light source device 300 lights the image display panel 200.

The light source device drive section 500 controls the luminance of the light source device 300 on the basis of a light source control signal SBL outputted from the signal processing section 120. The light source device 300 and the light source device drive section 500 are an embodiment of the light source section 3.

The processing operation of the signal processing section 120 is realized by the display driver IC 100*b* or the CPU 100*a*1 illustrated in FIG. 2.

If the processing operation of the signal processing section 120 is realized by the display driver IC 100*b*, then an input signal SRGB is inputted to the display driver IC 100*b* via the CPU 100*a*1. The display driver IC 100*b* generates an output signal SRGBW and controls the image display panel 200. In addition, the display driver IC 100*b* generates a light source control signal SBL and outputs it to the light source control driver IC 100*c* via the bus 100*f*.

If the processing operation of the signal processing section 120 is realized by the CPU 100*a*1, then an output signal SRGBW is inputted from the CPU 100*a*1 to the display driver IC 100*b*. A light source control signal SBL is also generated by the CPU 100*a*1 and is outputted to the light source control driver IC 100*c* via the bus 100*f*.

An example of the structure of functions which the signal processing section 120 of the display device 100 further has will now be described by the use of FIG. 6.

Figure 6:
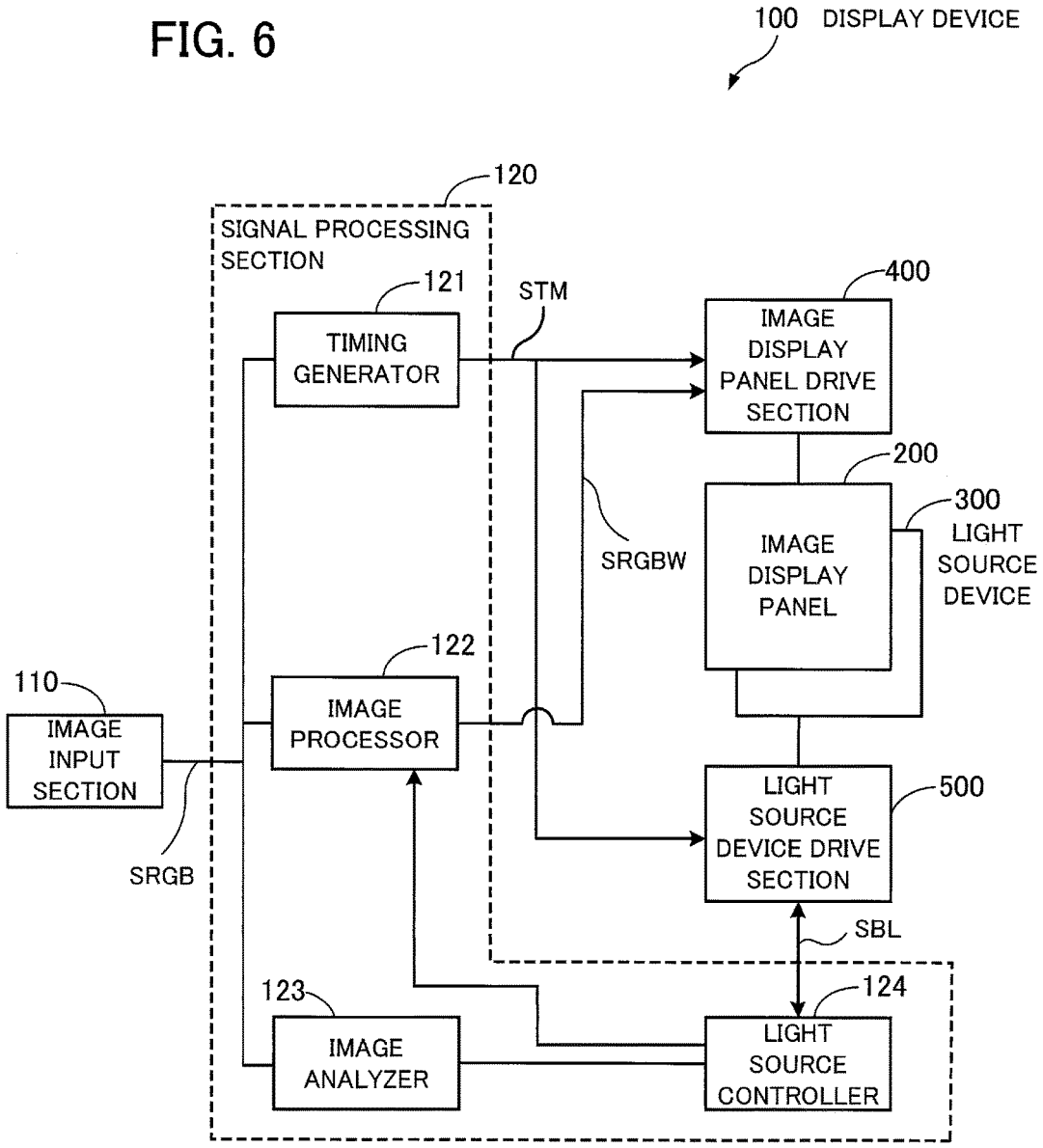
FIG. 6 is a block diagram of an example of the structure of the functions of a signal processing section included in the display device according to the second embodiment.

FIG. 6 is a block diagram of an example of the structure of the functions of the signal processing section included in the display device according to the second embodiment.

The signal processing section 120 includes a timing generator 121, an image processor 122, an image analyzer 123, and a light source controller 124. An input signal SRGB is inputted from the image input section 110 to each component of the signal processing section 120. The input signal SRGB includes color information on an image displayed at the position of each pixel 201 of the image display panel 200.

The timing generator 121 generates a synchronization signal STM for synchronizing the operation timing of the image display panel drive section 400 with that of the light source device drive section 500 every image display frame. The timing generator 121 outputs the generated synchronization signal STM to the image display panel drive section 400 and the light source device drive section 500.

The image processor 122 generates an output signal SRGBW on the basis of the input signal SRGB and luminance information by pixels for the light source device 300 inputted from the light source controller 124.

On the basis of the input signal SRGB, the image analyzer 123 calculates a block correspondence conversion coefficient of the light source device 300 required for each of blocks obtained by dividing a display surface of the image display panel 200. Each pixel 201 includes the fourth subpixel 202W, so its luminance can be adjusted (converted). A conversion coefficient for converting the luminance of each pixel 201 is determined according to the input signal SRGB. With division drive control of the light source device 300, the luminance of each pixel 201 is converted and the luminance of the light source device 300 is reduced according to an increase in the luminance of each pixel 201. The image analyzer 123 analyzes the input signal SRGB corresponding to each block and calculates a block correspondence conversion coefficient for converting the luminance of the light source device 300 by blocks. For example, the image analyzer 123 calculates a block correspondence conversion coefficient on the basis of at least one of saturation and a value of the input signal SRGB corresponding to each block.

The light source controller 124 determines a lighting pattern of the sidelight light source 302 on the basis of a block correspondence conversion coefficient for each block calculated by the image analyzer 123. In addition, the light source controller 124 determines on the basis of the lighting pattern whether a displayed image is a dynamic image or a static image, and sets according to a determination result the control speed of dimming control of each light source 303 included in the sidelight light source 302.

An example of the structure of functions which the light source controller 124 further has will now be described by the use of FIGS. 7A through 7C.

Figures 7A, 7B, 7C:
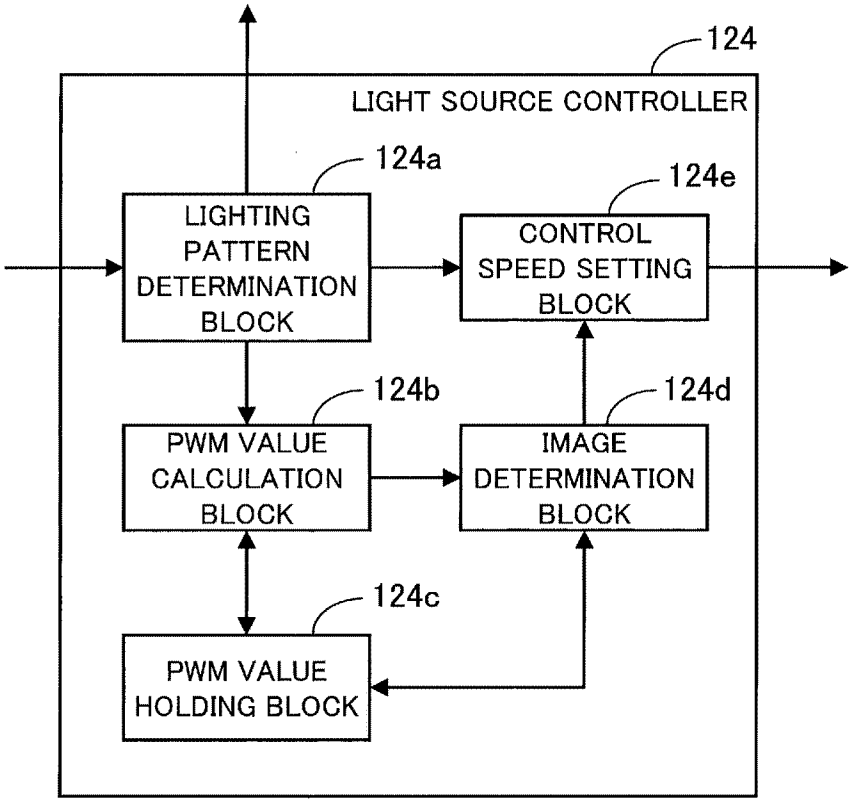
FIGS. 7A to 7C are block diagrams of an example of the structure of the functions of a light source controller included in the signal processing section of the display device according to the second embodiment.

FIG. 7A is a block diagram of an example of the structure of the functions of the light source controller included in the signal processing section of the display device according to the second embodiment. FIGS. 7B and 7C are views for describing the light source controller included in the signal processing section of the display device according to the second embodiment.

FIG. 7A illustrates an example of the structure of the functions of the light source controller 124. Each of FIGS. 7B and 7C illustrates an example of a change in PWM value corresponding to each frame of an arbitrary light source 303 of the sidelight light source 302 held in the light source controller 124.

As illustrated in FIG. 7A, the light source controller 124 includes a lighting pattern determination block 124*a*, a PWM value calculation block 124*b*, a PWM value holding block 124*c*, an image determination block 124*d*, and a control speed setting block 124*e*.

The lighting pattern determination block 124*a* determines a lighting pattern of each light source 303 included in the sidelight light source 302 on the basis of a block correspondence conversion coefficient for each block calculated by the image analyzer 123. For example, the light source controller 124 holds as a table luminance distribution information regarding the distribution of luminance values according to the blocks of the light source device 300 detected at the time of lighting each light source 303 at a determined lighting amount, and determines a lighting pattern by the use of the table with a block correspondence conversion coefficient. Furthermore, the lighting pattern determination block 124*a* calculates luminance information regarding luminance values of the light source device 300 according to pixels at the time of lighting each light source 303 according to the determined lighting pattern, and informs the image processor 122 of the calculated luminance information.

On the basis of the lighting pattern determined by the lighting pattern determination block 124*a*, the PWM value calculation block 124*b* calculates a PWM value to be inputted to each light source 303 for lighting each light source 303 according to the lighting pattern.

The PWM value holding block 124*c* holds PWM values according to the light sources 303 calculated by the PWM value calculation block 124*b* for one image display frame. As illustrated in FIG. 7B or 7C, for example, the PWM value holding block 124*c* holds information indicative of PWM values according to frames for an arbitrary light source 303 included in the sidelight light source 302.

On the basis of information indicative of PWM values according to frames for a light source 303 held by the PWM value holding block 124*c*, the image determination block 124*d* determines whether a displayed image is a dynamic image or a static image. Alternatively, the PWM value calculation block 124*b* acquires information indicative of PWM values according to frames for a light source 303 from the PWM value holding block 124*c* and the image determination block 124*d* determines on the basis of the information indicative of PWM values according to frames for the light source 303 acquired by the PWM value calculation block 124*b* whether a displayed image is a dynamic image or a static image.

On the basis of the result of the determination made by the image determination block 124*d*, the control speed setting block 124*e* sets the control speed of dimming control of the sidelight light source 302 according to lighting patterns determined by the lighting pattern determination block 124*a*.

A case where an expansion coefficient α is used as the conversion coefficient for increasing the luminance of each pixel or the conversion coefficient for reducing the luminance of the light source device 300 will now be described by the use of FIG. 8.

Figure 8:
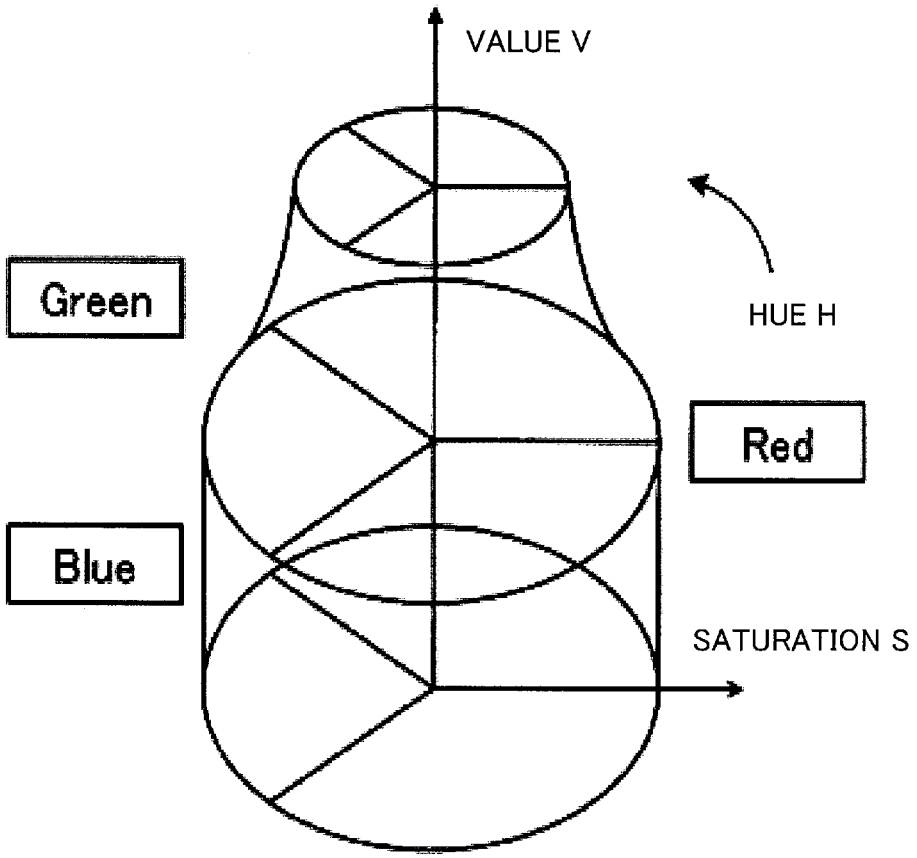
FIG. 8 is a schematic view of reproduction HSV color space which can be reproduced by the display device according to the second embodiment.

FIG. 8 is a schematic view of reproduction HSV color space which can be reproduced by the display device according to the second embodiment.

With the display device 100 each pixel 201 includes the fourth subpixel 202W which outputs the fourth color (white). This extends the dynamic range of a value in reproduction HSV color space which can be reproduced by the display device 100. "H" represents hue, "S" represents saturation, and "V" represents a value.

As illustrated in FIG. 8, the reproduction HSV color space to which the fourth color has been added has a shape obtained by putting an approximately trapezoid solid in which, as the saturation S increases, the maximum value of the value V becomes smaller on cylindrical HSV color space which the first subpixel 202R, the second subpixel 202G, and the third subpixel 202B display. The signal processing section 120 stores the maximum value Vmax(S) of a value expressed with the saturation S in the reproduction HSV color space which has been extended by adding the fourth color as a variable. That is to say, the signal processing section 120 stores the maximum value Vmax(S) of a value by the coordinates (values) of the saturation S and the hue H for the solid shape of the reproduction HSV color space illustrated in FIG. 8.

An input signal SRGB includes input signal values corresponding to the first primary color, the second primary color, and third primary color, so HSV color space of the input signal SRGB has a cylindrical shape, that is to say, has the same shape as a cylindrical portion of the reproduction HSV color space illustrated in FIG. 8 has. Accordingly, an output signal SRGBW is calculated as an expanded image signal obtained by expanding the input signal SRGB to make it fall within the reproduction HSV color space. The input signal SRGB is expanded by the use of the expansion coefficient α determined by comparing the value level of each subpixel of the input signal SRGB in the reproduction HSV color space. By expanding the level of the input signal SRGB by the use of the expansion coefficient α, an output signal value corresponding to the fourth subpixel 202W can be made large. This increases the luminance of an entire image. At this time the luminance of the light source device 300 is reduced to 1/α according to an increase in the luminance of the entire image caused by the use of the expansion coefficient α. By doing so, display is performed with exactly the same luminance as with the input signal SRGB.

The expansion of an input signal SRGB will now be described.

In the signal processing section 120, an output signal value $X1_{(p,\ q)}$ corresponding to the first subpixel 202R, an output signal value $X2_{(p,\ q)}$ corresponding to the second subpixel 202G, and an output signal value $X3_{(p,\ q)}$ corresponding to the third subpixel 202B for a (p, q)th pixel (or a combination of the first subpixel 202R, the second subpixel 202G, and the third subpixel 202B) are expressed as:

$$X1_{(p,q)}=\alpha\cdot x1_{(p,q)}-\chi\cdot X4_{(p,q)} \quad (1)$$

$$X2_{(p,q)}=\alpha\cdot x2_{(p,q)}-\chi\cdot X4_{(p,q)} \quad (2)$$

$$X3_{(p,q)}=\alpha\cdot x3_{(p,q)}-\chi\cdot X4_{(p,q)} \quad (3)$$

where α is an expansion coefficient and χ is a constant which depends on the display device 100. χ will be described later.

In addition, an output signal value $X4_{(p,\ q)}$ is calculated on the basis of the product of $Min_{(p,\ q)}$ and the expansion coefficient α, where $Min_{(p,\ q)}$ is the minimum value of an input signal value $x1_{(p,\ q)}$ corresponding to the first subpixel 202R, an input signal value $x2_{(p,\ q)}$ corresponding to the second subpixel 202G, and an input signal value $x3_{(p,\ q)}$ corresponding to the third subpixel 202B. To be concrete, an output signal value $X4_{(p,\ q)}$ is found on the basis of $$X4_{(p,q)}=Min_{(p,q)}\cdot\alpha/\chi \quad (4)$$

In expression (4), the product of $Min_{(p,\ q)}$ and the expansion coefficient α is divided by χ. However, another calculation method may be adopted. Furthermore, the expansion coefficient α is determined every image display frame.

These points will now be described.

On the basis of an input signal SRGB for a (p, q)th pixel including an input signal value $x1_{(p,\ q)}$ corresponding to the first subpixel 202R, an input signal value $x2_{(p,\ q)}$ corresponding to the second subpixel 202G, and an input signal value $x3_{(p, q)}$ corresponding to the third subpixel 202B, usually saturation $S_{(p, q)}$ and value $V(S)_{(p, q)}$ in the cylindrical HSV color space are found from $$S_{(p,q)}=(\mathrm{Max}_{(p,q)}-\mathrm{Min}_{(p,q)})/\mathrm{Max}_{(p,q)} \quad (5)$$

$$V(S)_{(p,q)}=\mathrm{Max}_{(p,q)} \quad (6)$$

where $\mathrm{Max}_{(p, q)}$ is the maximum value of the input signal value $x1_{(p, q)}$ corresponding to the first subpixel 202R, the input signal value $x2_{(p, q)}$ corresponding to the second subpixel 202G, and the input signal value $x3_{(p, q)}$ corresponding to the third subpixel 202B, $\mathrm{Min}_{(p, q)}$, as stated above, is the minimum value of the input signal value $x1_{(p, q)}$ corresponding to the first subpixel 202R, the input signal value $x2_{(p, q)}$ corresponding to the second subpixel 202G, and the input signal value $x3_{(p, q)}$ corresponding to the third subpixel 202B, the saturation S has a value in the range of 0 to 1, and the value V(S) has a value in the range of 0 to $(2^n-1)$, where n is a display gradation bit number.

A color filter is not disposed between the fourth subpixel 202W which displays white and an observer of an image. If the first subpixel 202R which displays the first primary color, the second subpixel 202G which displays the second primary color, the third subpixel 202B which displays the third primary color, and the fourth subpixel 202W which displays the fourth color are lit at the same light source lighting amount, then the fourth subpixel 202W is brighter than the first subpixel 202R, the second subpixel 202G, and the third subpixel 202B. It is assumed that when a signal value corresponding to the maximum value of output signal values corresponding to the first subpixels 202R is inputted to a first subpixel 202R, a signal value corresponding to the maximum value of output signal values corresponding to the second subpixels 202G is inputted to a second subpixel 202G, and a signal value corresponding to the maximum value of output signal values corresponding to the third subpixels 202B is inputted to a third subpixel 202B, the luminance of a set of a first subpixel 202R, a second subpixel 202G, and a third subpixel 202B included in each pixel 201 or the luminance of a set of first subpixels 202R, second subpixels 202G, and third subpixels 202B included in a group of pixels 201 is $BN_{1-3}$. Furthermore, it is assumed that when a signal value corresponding to the maximum value of output signal values corresponding to a fourth subpixel 202W included in each pixel 201 or fourth subpixels 202W included in a group of pixels 201 is inputted to a fourth subpixel 202W, the luminance of the fourth subpixel 202W is $BN_4$. That is to say, white which has the maximum luminance is displayed by a set of a first subpixel 202R, a second subpixel 202G, and a third subpixel 202B and the luminance of white is $BN_{1-3}$. As a result, the constant $\chi$ which depends on the display device 100 is expressed as $$\chi=BN_4/BN_{1-3}$$

By the way, if the output signal value $X4_{(p, q)}$ is given by the above expression (4), the maximum value Vmax(S) of a value is expressed, with the saturation S in the reproduction HSV color space as a variable, as:

If $S \leq S_0$, then $$V\max(S)=(\chi+1)\cdot(2^n-1) \quad (7)$$

If $S_0<S\leq 1$, then $$V\max(S)=(2^n-1)\cdot(1/S) \quad (8)$$

where $S_0=1/(\chi+1)$.

The maximum value Vmax(S) of a value which is expressed with the saturation S in the reproduction HSV color space that has been extended by adding the fourth color as a variable and which is obtained in this way is stored in, for example, the signal processing section 120 as a type of lookup table. Alternatively, the maximum value Vmax(S) of a value expressed with the saturation S in the reproduction HSV color space as a variable is found every time by the signal processing section 120.

The expansion coefficient $\alpha$ is used for expanding the value V(S) in the HSV color space into the reproduction HSV color space and is expressed as $$\alpha(S)=V\max(S)/V(S) \quad (9)$$

In expansion calculation, the expansion coefficient $\alpha$ is determined on the basis of, for example, $\alpha(S)$ found for plural pixels 201.

Signal processing performed by the signal processing section 120 by the use of the expansion coefficient $\alpha$ will now be described. The following signal processing is performed so that the ratio among the luminance of the first primary color displayed by (first subpixel 202R+fourth subpixel 202W), the luminance of the second primary color displayed by (second subpixel 202G+fourth subpixel 202W), and the luminance of the third primary color displayed by (third subpixel 202B+fourth subpixel 202W) will be held, so that a color tone will be held (maintained), and so that a gradation-luminance characteristic (gamma ($\gamma$) characteristic) will be held (maintained). Furthermore, if all input signal values are 0 or small for a pixel 201 or a group of pixels 201, then the expansion coefficient $\alpha$ may be calculated with the pixel 201 or the group of pixels 201 excluded.

A process performed by the image analyzer 123 will be described. On the basis of an input signal SRGB for plural pixels 201 included in a block, the image analyzer 123 finds the saturation S and the value V(S) of the plural pixels 201. To be concrete, the image analyzer 123 uses an input signal value $x1_{(p, q)}$, an input signal value $x2_{(p, q)}$, and an input signal value $x3_{(p, q)}$ for a (p, q)th pixel 201 and finds $S_{(p, q)}$, and $V(S)_{(p, q)}$ from expressions (5) and (6) respectively. The image analyzer 123 performs this process on all pixels in the block. As a result, combinations of $(S_{(p, q)}, V(S)_{(p, q)})$ the number of which corresponds to the number of the pixels in the block are obtained. Next, the image analyzer 123 finds the expansion coefficient $\alpha$ on the basis of at least one of $\alpha(S)$ values found for the pixels in the block. For example, the image analyzer 123 considers the smallest value of $\alpha(S)$ values found for the pixels in the block as the expansion coefficient $\alpha$ for the block. The image analyzer 123 calculates the expansion coefficient $\alpha$ for the block in this way.

The image analyzer 123 repeats this procedure according to blocks and calculates the expansion coefficient $\alpha$ for each block. Luminance required for a block is calculated by $1/\alpha$ which is the reciprocal of the expansion coefficient $\alpha$. $1/\alpha$ is an example of the block correspondence conversion coefficient.

Signal processing performed by the signal processing section 120 the structure of the functions of which is described above will now be described by the use of FIG. 9.

Figure 9:
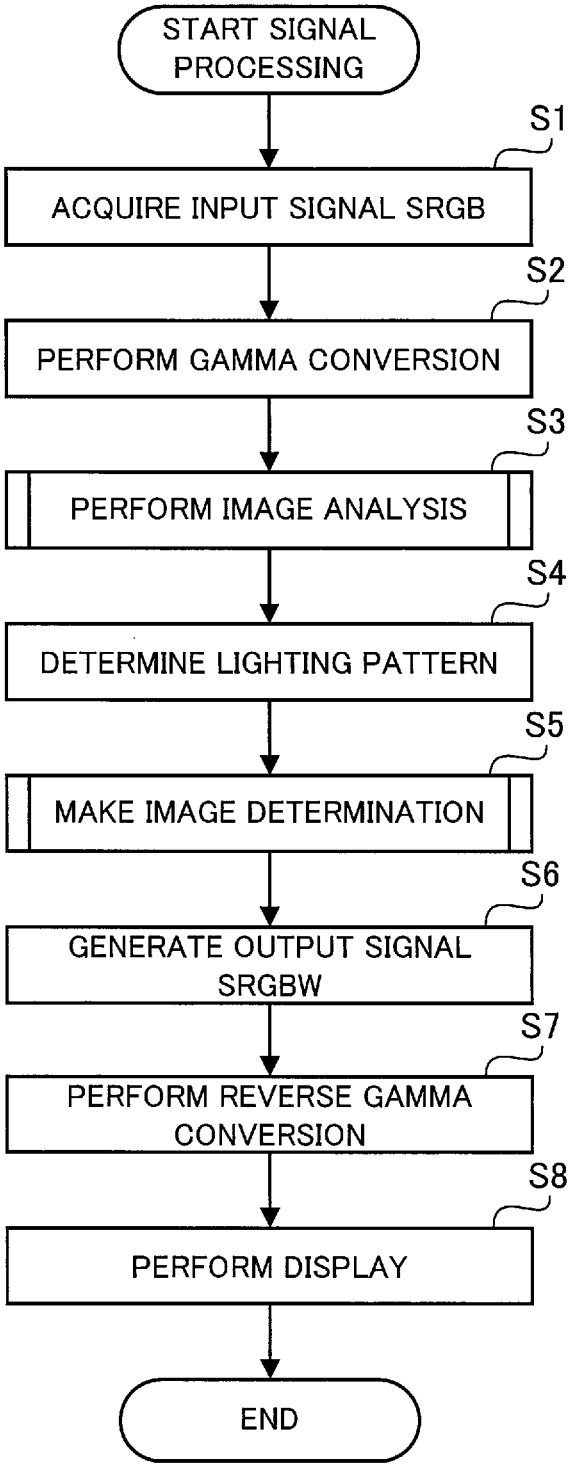
FIG. 9 is a flow chart of signal processing for image display performed by the display device according to the second embodiment.

FIG. 9 is a flow chart of signal processing for image display performed by the display device according to the second embodiment.

The display device 100 starts a process every image display frame. An input signal SRGB is inputted via the image input section 110 to the signal processing section 120.

(Step S1) The signal processing section 120 acquires the input signal SRGB.

(Step S2) The signal processing section 120 gamma-converts the input signal SRGB to linearize it.

(Step S3) The image analyzer 123 acquires the linearized input signal SRGB and performs an image analysis. In the image analysis, the image analyzer 123 calculates a block correspondence conversion coefficient of the light source device 300 on the basis of the input signal SRGB for each of blocks obtained by dividing the display surface of the image display panel 200. The details of the image analysis will be described later.

(Step S4) The light source controller 124 (lighting pattern determination block 124*a*) acquires a block correspondence conversion coefficient for each block and determines a lighting pattern of each light source 303 which satisfies the block correspondence conversion coefficient.

(Step S5) On the basis of the lighting pattern of each light source 303 determined in step S4, the light source controller 124 determines whether an image based on the input signal SRGB is a dynamic image or a static image. Furthermore, the light source controller 124 outputs to the light source device drive section 500 a light source control signal SBL in which a control speed is set according to the lighting pattern and a determination result. The details of the image determination will be described later.

(Step S6) The image processor 122 generates an output signal SRGBW for each pixel from the input signal SRGB. In the generation of the output signal SRGBW, the image processor 122 calculates from luminance information for the light source device 300 the expansion coefficient $\alpha$ for each pixel for expanding the input signal SRGB, uses the calculated expansion coefficient $\alpha$ for expanding the input signal SRGB, and generates the output signal SRGBW.

(Step S7) The image processor 122 performs reverse gamma conversion on the output signal SRGBW and outputs it to the image display panel drive section 400.

(Step S8) Display is performed. In synchronization with a synchronization signal STM generated by the timing generator 121, the image display panel drive section 400 outputs the output signal SRGBW to the image display panel 200 to display am image, and the light source device drive section 500 outputs to the light source device 300 the light source control signal SBL in which a control speed is changed to drive the light sources 303.

By performing the above process, an image of the input signal SRGB is reproduced on the image display panel 200. The luminance of the light source device 300 which lights the image display panel 200 is controlled by blocks according to the input signal SRGB. This reduces the luminance of the light source device 300 and reduces its power consumption.

The details of the image analysis (step S3) performed in the above signal processing (FIG. 9) will now be described by the use of FIG. 10.

Figure 10:
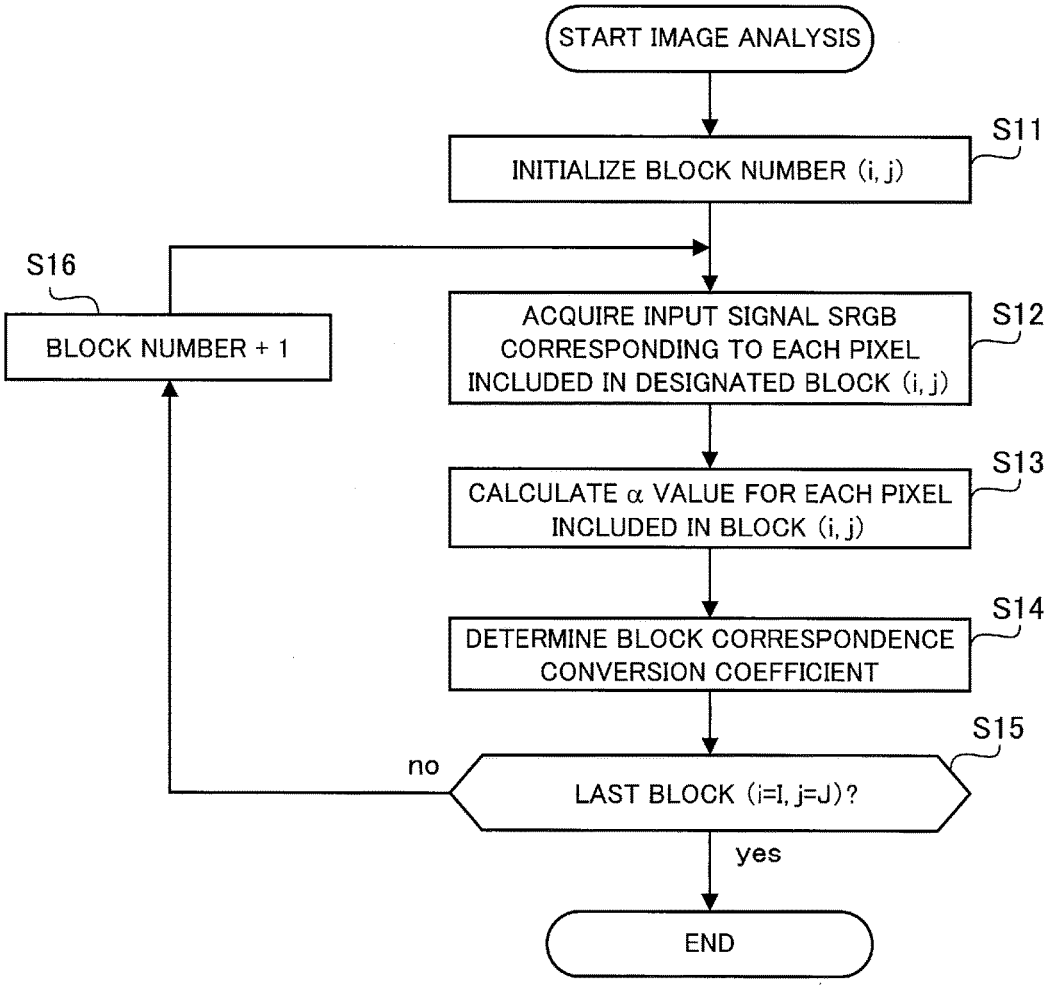
FIG. 10 is a flow chart of an image analysis performed by the display device according to the second embodiment.

FIG. 10 is a flow chart of the image analysis performed by the display device according to the second embodiment.

The image analyzer 123 acquires the input signal SRGB and starts the following subprocess. The emission surface of the light source device 300 is divided into (I×J) blocks.

(Step S11) The image analyzer 123 initializes a block number (i, j) by which a block to be processed is designated (i=1 and j=1).

(Step S12) The image analyzer 123 acquires an input signal SRGB corresponding to each pixel included in a designated block (i, j).

(Step S13) The image analyzer 123 calculates an a value for each pixel. To be concrete, the image analyzer 123 finds saturation $S_{(p,q)}$ and value $V(S)_{(p,q)}$ in the cylindrical HSV color space from an input signal SRGB corresponding to a target pixel by the use of expressions (5) and (6). The image analyzer 123 finds an a value for the pixel from the saturation $S_{(p,q)}$ and the value $V(S)_{(p,q)}$ obtained in this way by the use of expression (9). The image analyzer 123 repeats the same procedure to calculate a values for all pixels included in the block (i, j).

(Step S14) The image analyzer 123 determines a block correspondence conversion coefficient for the block (i, j) on the basis of at least one of the $\alpha$ values for all the pixels. For example, the image analyzer 123 selects the smallest $\alpha$ value from among the $\alpha$ values for all the pixels included in the block (i, j), and considers the reciprocal $1/\alpha$ of the smallest $\alpha$ value as a block correspondence conversion coefficient for the block (i, j).

(Step S15) The image analyzer 123 compares the block number (i, j) and the last block number (I, J) and determines whether or not the block (i, j) is the last block.

If (i, j)=(I, J), then the image analyzer 123 determines that the block (i, j) is the last block. In this case, the image analyzer 123 has calculated block correspondence conversion coefficients for all the blocks. Accordingly, the image analyzer 123 ends the subprocess. If the block (i, j) is not the last block, then the image analyzer 123 proceeds to step S16.

(Step S16) The image analyzer 123 increments the block number (i, j) by 1 and returns to step S12.

The image determination (step S5) performed in the above signal processing (FIG. 9) will now be described by the use of FIG. 11.

Figure 11:
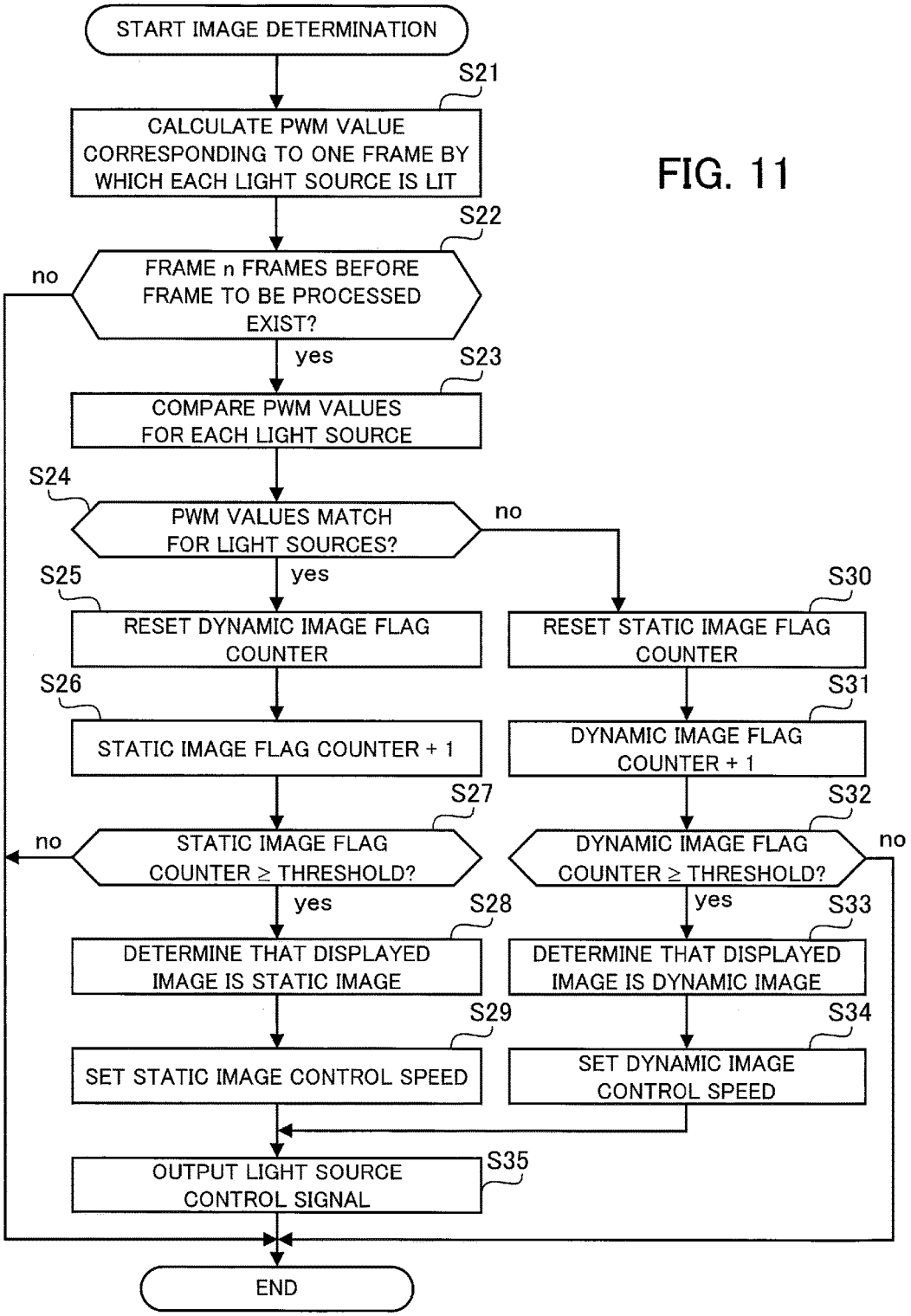
FIG. 11 is a flow chart of image determination performed by the display device according to the second embodiment.

FIG. 11 is a flow chart of the image determination performed by the display device according to the second embodiment.

Each time a lighting pattern for one image display frame (hereinafter simply referred to as a "frame") is determined, the light source controller 124 performs the following subprocess.

(Step S21) On the basis of the lighting pattern determined in step S4, the PWM value calculation block 124*b* of the light source controller 124 calculates a PWM value corresponding to one frame by which each light source 303 is lit according to the lighting pattern.

The PWM value calculation block 124*b* makes the PWM value holding block 124*c* hold a calculated PWM value for each light source 303.

(Step S22) The image determination block 124*d* of the light source controller 124 refers to the PWM value holding block 124*c* and determines whether or not there is a frame n frames before the frame to be processed.

If there is a frame n frames before the frame to be processed, then the image determination block 124*d* proceeds to step S23. If there is no frame n frames before the frame to be processed, then the image determination block 124*d* ends the image determination.

For example, if n=1, then the image determination block 124*d* determines whether or not there is a frame one frame before the frame to be processed. Specifically, in the example of FIG. 7B or 7C, it is assumed that the frame to be processed is the fifth frame. Then the image determination block 124*d* determines whether or not there is a fourth frame. Furthermore, for example, it is assumed that the frame to be processed is the first frame. Then there is no frame one frame before the frame to be processed, so the image determination block 124*d* ends the image determination.

In addition, if n=2, then the image determination block 124*d* determines whether or not there is a frame two frames before the frame to be processed. Specifically, in the example of FIG. 7B or 7C, it is assumed that the frame to be processed is the fifth frame. Then the image determination block 124*d* determines whether or not there is a third frame, which is two frames before the frame to be processed. Furthermore, for example, it is assumed that the frame to be processed is the second frame. Then there is no frame two frames before the frame to be processed, so the image determination block 124*d* ends the image determination.

In which is an interval for a frame comparison is set in advance according to the number of image display frames per second. Furthermore, in image determination described later, n may be set to different values depending on whether a displayed image is a dynamic image or a static image.

(Step S23) The image determination block 124*d* refers to the PWM value holding block 124*c* and compares a PWM value corresponding to the frame to be processed and a PWM value corresponding to the frame n frames before the frame to be processed for each light source 303.

(Step S24) The image determination block 124*d* determines whether or not the PWM value corresponding to the frame to be processed matches the PWM value corresponding to the frame n frames before the frame to be processed for each light source 303.

If the PWM value corresponding to the frame to be processed matches the PWM value corresponding to the frame n frames before the frame to be processed for each light source 303, then the image determination block 124*d* proceeds to step S25. If the PWM value corresponding to the frame to be processed does not match the PWM value corresponding to the frame n frames before the frame to be processed for each light source 303, then the image determination block 124*d* proceeds to step S30.

For example, it is assumed that the frame to be processed is the fifth frame. As illustrated in FIG. 7B, a PWM value corresponding to the fourth frame and a PWM value corresponding to the fifth frame are the same (192, for example) for an arbitrary light source 303. Furthermore, if a PWM value corresponding to the fourth frame and a PWM value corresponding to the fifth frame are also the same for the other light sources 303, then the image determination block 124*d* proceeds to step S25.

In addition, as illustrated in FIG. 7C, if a PWM value corresponding to the fourth frame and a PWM value corresponding to the fifth frame after update are not the same, that is to say, a PWM value changes (from 120 to 155) for an arbitrary light source 303, then the image determination block 124*d* proceeds to step S30.

(Step S25) The image determination block 124*d* resets a dynamic image flag counter which indicates the number of times a dynamic image is displayed.

(Step S26) The image determination block 124*d* increments a static image flag counter which indicates the number of times a static image is displayed by 1.

(Step S27) The image determination block 124*d* determines whether or not the static image flag counter which has been incremented by 1 is greater than or equal to a determined threshold.

If the static image flag counter is greater than or equal to the determined threshold, then the image determination block 124*d* proceeds to step S28. If the static image flag counter is smaller than the determined threshold, then the image determination block 124*d* ends the image determination.

For example, it is assumed that a threshold frame number is 5, that PWM values corresponding to first through fourth frames are constant for an arbitrary light source 303, and that PWM values corresponding to the first through fourth frames are also constant for the other light sources 303. If PWM values corresponding to this time (fifth frame) are the same as those corresponding to the last time for all the light sources 303, then the static image flag counter is incremented by 1 and reaches the threshold frame number 5. Accordingly, the image determination block 124*d* proceeds to step S28.

(Step S28) An image does not change among different frames, so the image determination block 124*d* determines that a displayed image is a static image.

(Step S29) The control speed setting block 124*e* sets a static image control speed (which is higher than a dynamic image control speed) in dimming control based on a light source control signal SBL corresponding to a lighting pattern.

(Step S30) The image determination block 124*d* resets the static image flag counter.

(Step S31) The image determination block 124*d* increments the dynamic image flag counter by 1.

(Step S32) The image determination block 124*d* determines whether or not the dynamic image flag counter which has been incremented by 1 is greater than or equal to a determined threshold.

If the dynamic image flag counter is greater than or equal to the determined threshold, then the image determination block 124*d* proceeds to step S33. If the dynamic image flag counter is smaller than the determined threshold, then the image determination block 124*d* ends the image determination.

For example, it is assumed that a threshold frame number is 5 and that PWM values corresponding to first through fourth frames are not constant, that is to say, change for an arbitrary light source 303. If a PWM value corresponding to this time (fifth frame) is also different from that corresponding to the last time for the light source 303, then the dynamic image flag counter is incremented by 1 and reaches the threshold frame number 5. Accordingly, the image determination block 124*d* proceeds to step S33.

(Step S33) An image changes among different frames, so the image determination block 124*d* determines that a displayed image is a dynamic image.

(Step S34) The control speed setting block 124*e* sets the dynamic image control speed (which is lower than the static image control speed) in dimming control based on a light source control signal SBL corresponding to a lighting pattern.

(Step S35) The control speed setting block 124*e* outputs to the light source device drive section 500 the light source control signal SBL in which a control speed is set.

The threshold frame number (5) used in the above steps S27 and S32 is an example and another number may be used. Furthermore, different thresholds may be set in steps S27 and S32.

With the display device 100, a light source control signal SBL in which the dynamic image control speed or the static image control speed is set according to the result of the above image determination is outputted to the light source device drive section 500, the light source device 300 emits light, and an image is displayed.

A change in PWM value corresponding to each frame of the light source device 300 at the time of displaying an image by the above display device 100 will now be described by the use of FIGS. 12A and 12B.

Figure 12A:
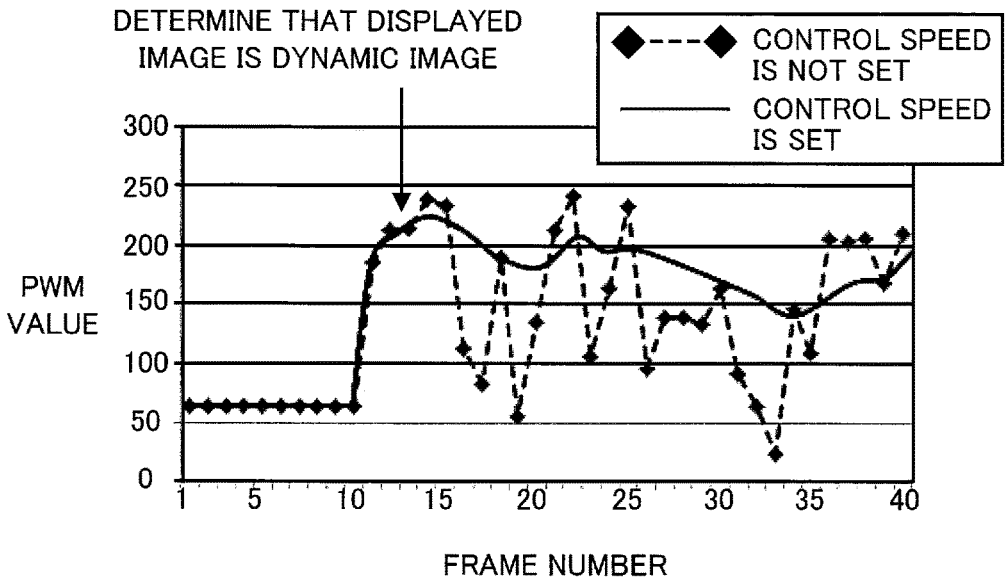
FIGS. 12A and 12B are graphs indicative of examples of a change in PWM value corresponding to each image display frame in the display device according to the second embodiment.
Figure 12B:
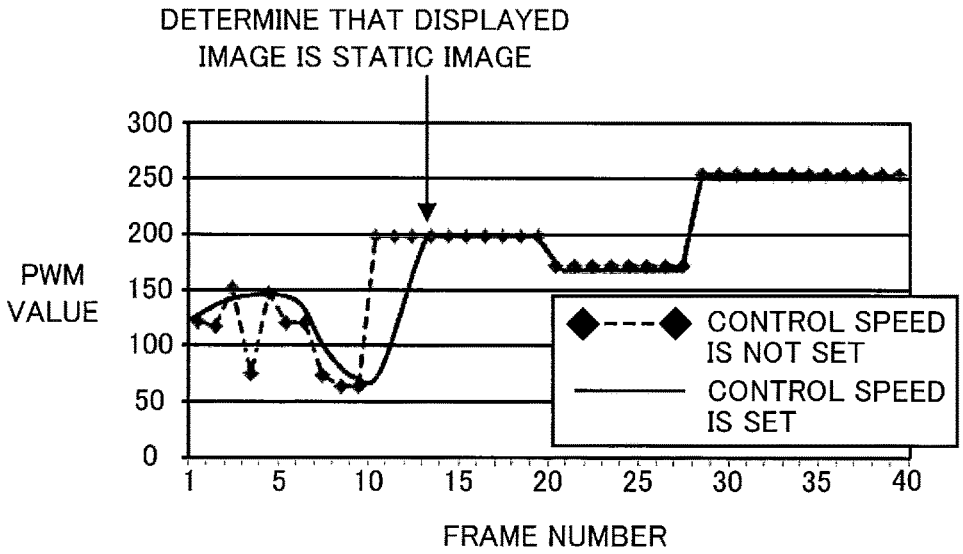

FIGS. 12A and 12B are graphs indicative of examples of a change in PWM value corresponding to each image display frame in the display device according to the second embodiment.

In FIGS. 12A and 12B, a case where a control speed is not set is indicated by a dashed line and a case where a control speed is set is indicated by a solid line. Furthermore, in FIGS. 12A and 12B, a horizontal axis indicates a frame number and a vertical axis indicates a PWM value. A threshold frame number for image determination is, for example, 2. In addition, FIG. 12A indicates a case where a displayed image changes from a static image to a dynamic image, and FIG. 12B indicates a case where a displayed image changes from a dynamic image to a static image.

In the case of FIG. 12A, PWM values corresponding to first through tenth frames are constant and a displayed image is a static image. However, a PWM value corresponding to an eleventh frame changes and a PWM value corresponding to a twelfth frame also changes. That is to say, the PWM values corresponding to the two frames change in succession (dashed line in FIG. 12A). At this time the image determination block 124*d* determines from this change in PWM value that a displayed image is a dynamic image, and sets the dynamic image control speed, which is lower than the static image control speed, in dimming control of the light sources 303 (solid line in FIG. 12A). When the dynamic image control speed is set, the change from a PWM value corresponding to an mth frame to a PWM value corresponding to an (m+1)th frame becomes slower. As a result, as illustrated in FIG. 12A, a PWM value does not change suddenly, that is to say, changes slowly with an increase in the number of frames. Accordingly, a change in the light emission luminance of the light source device 300 caused by dimming control is slow, so a sudden change in the luminance of an image displayed by the display device 100 is controlled.

In the case of FIG. 12B, PWM values corresponding to first through tenth frames vary and a displayed image is a dynamic image. However, after a PWM value corresponding to an eleventh frame changes, a PWM value corresponding to a twelfth frame is the same as that corresponding to the eleventh frame. That is to say, the PWM values corresponding to the two frames are constant in succession (dashed line in FIG. 12B). At this time the image determination block 124*d* determines that a displayed image is a static image, and sets the static image control speed, which is higher than the dynamic image control speed, in dimming control of the light sources 303 (solid line in FIG. 12B). When the static image control speed is set, the change from a PWM value corresponding to an mth frame to a PWM value corresponding to an (m+1)th frame becomes quicker. As a result, as illustrated in FIG. 12B, particularly when a displayed image changes from a dynamic image to a static image, a delay in a change in the light emission luminance of the light source device 300 after the change in the displayed image is suppressed. Accordingly, a change in the light emission luminance of the light source device 300 follows the change in the displayed image. This prevents an image displayed by the display device 100 from waving.

The display device 100 suppresses in this way image quality degradation caused at the time of displaying a dynamic image or a static image.

In addition, results obtained by the use of some of the expansion coefficients α for the pixels obtained from an input signal SRGB are not outside the reproduction HSV color space illustrated in FIG. 8. That is to say, the input signal SRGB corresponding to pixels is expanded without image quality degradation. Results obtained by the use of the others are outside the reproduction HSV color space illustrated in FIG. 8. That is to say, image quality degradation occurs and the input signal SRGB corresponding to pixels is not expanded. There are two modes according to the ratios of these expansion coefficients α to all the expansion coefficients α. In a power reduction priority mode, image quality degradation occurs, but power consumption is reduced. In an image quality priority mode, power consumption is not reduced, but image quality is improved.

If an image displayed by the display device 100 is a dynamic image, the image changes. Accordingly, image quality degradation is tolerated to a certain extent. On the other hand, if an image displayed by the display device 100 is a static image, the image does not change. Accordingly, it is desirable to keep image quality at a certain level.

Accordingly, if an image displayed by the display device 100 is a dynamic image, the control speed setting block 124*e* sets the dynamic image control speed (step S34) and sets the power reduction priority mode in which the ratio of expansion coefficients α by which obtained results are outside the reproduction HSV color space to all the expansion coefficients α rises. On the other hand, if an image displayed by the display device 100 is a static image, the control speed setting block 124*e* sets the static image control speed (step S29) and sets the image quality priority mode in which the ratio of expansion coefficients α by which obtained results are outside the reproduction HSV color space to all the expansion coefficients α falls.

This makes it possible for the display device 100 to reduce power consumption or further improve image quality, while suppressing image quality degradation caused at the time of displaying a dynamic image or a static image.

The above processing functions can be realized with a computer. In that case, a program in which the contents of the functions that the display device has are described is provided. By executing this program on the computer, the above processing functions are realized on the computer. This program may be recorded on a computer readable record medium. A computer readable record medium may be a magnetic storage device, an optical disk, a magneto-optical recording medium, a semiconductor memory, or the like. A magnetic storage device may be a hard disk drive (HDD), a flexible disk (FD), a magnetic tape, or the like. An optical disk may be a digital versatile disc (DVD), a DVD-RAM, a compact disc (CD)-ROM, a CD-recordable (R)/rewritable (RW), or the like. A magneto-optical recording medium may be a magneto-optical disk (MO) or the like.

To place the program on the market, portable record media, such as DVDs or CD-ROMs, on which it is recorded are sold. Alternatively, the program is stored in advance in a storage unit of a server computer and is transferred from the server computer to another computer via a network.

When a computer executes this program, it will store the program, which is recorded on a portable record medium or which is transferred from the server computer, in, for example, its storage unit. Then the computer reads the program from its storage unit and performs processes in compliance with the program. The computer may read the program directly from a portable record medium and perform processes in compliance with the program. Furthermore, each time the program is transferred from the server computer connected via a network, the computer may perform processes in order in compliance with the program it receives.

In addition, at least a part of the above processing functions may be realized by an electronic circuit such as a digital signal processor (DSP), an application specific integrated circuit (ASIC), or a programmable logic device (PLD).

In the embodiments of the present disclosure a liquid crystal display is taken as an example. However, the embodiments of the present disclosure are also applicable to all flat panel display devices, such as other self light emission display devices and electronic paper display devices including electrophoretic elements or the like. Furthermore, it is a matter of course that the embodiments of the present disclosure are applicable to small-to-medium-sized to large-sized flat panel display devices without special limitations.

Various changes and modifications which fall within the scope of the concept of the present invention are conceivable by those skilled in the art and it is understood that these changes and modifications fall within the scope of the present disclosure. For example, those skilled in the art may add components to, delete components from, or make changes in the design of components in each of the above embodiments according to circumstances, or may add processes to, omit processes from, or make changes in conditions in processes in each of the above embodiments according to circumstances. These additions, deletions, changes, and omissions fall within the scope of the present disclosure if they include the essentials of the present disclosure.

In addition, of course it is understood that other functions and effects which are obtained by the circumstances described in the embodiments and which are clear from the specification or which are conceivable by those skilled in the art according to circumstances are realized by the present invention.

The present disclosure includes the following aspects.

(1). A display device including: an image display panel section which displays an image on the basis of an image signal; a light source section which emits light to the image display panel section by dimming control according to a control signal based on the image signal; and a control section which determines on the basis of the image signal from a mode of change in light emission luminance of the light source section whether the image displayed by the image display panel section is a dynamic image or a static image and which performs switching according to a determination result between a static image control speed and a dynamic image control speed of the dimming control.

(2). The display device according to (1), wherein when the control section determines that the image displayed by the image display panel section is a dynamic image, the control section switches the static image control speed to the dynamic image control speed which is lower than the static image control speed.

(3). The display device according to (1), wherein when the control section determines that the image displayed by the image display panel section is a static image, the control section switches the dynamic image control speed to the static image control speed which is higher than the dynamic image control speed.

(4). The display device according to any of (1) to (3), wherein the control section specifies the mode of change in the light emission luminance of the light source section on the basis of the image signal.

(5). The display device according to (4), wherein the control section specifies the mode of change in the light emission luminance of the light source section on the basis of a PWM value by which the light emission luminance is changed according to a width of a PWM pulse and which is obtained from the image signal.

(6). The display device according to (5), wherein: the light source section includes a plurality of light source elements; and each of the plurality of light source elements emits light according to the PWM value.

(7). The display device according to any of (1) to (6), wherein: each time the control section makes a same determination, the control section counts a number of times a determination is made; and the control section performs switching between the static image control speed and the dynamic image control speed according to the number of times a determination is made.

(8). The display device according to (1), wherein: the control section generates on the basis of the image signal a conversion coefficient corresponding to each pixel which has a limit value for conversion of luminance of said each pixel on the basis of a hue for said each pixel and by which the luminance of said each pixel is converted; and the control section sets according to the determination result a ratio of conversion coefficients by which the luminance is converted over the limit value.

(9). A method for driving a display device, the display device including an image display panel section, a light source section, and a control section, the method including: displaying an image on the basis of an image signal by the image display panel section; emitting light to the image display panel section by dimming control according to a control signal based on the image signal by the light source section; and determining on the basis of the image signal from a mode of change in light emission luminance of the light source section whether the image displayed by the image display panel section is a dynamic image or a static image and switching according to a determination result between a static image control speed and a dynamic image control speed of the dimming control by the control section.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. A display device comprising:

an image display panel configured to display an image on the basis of an image signal;

a light source configured to light to the image display panel by a dimming control according to a control signal that determines a light emission luminance of the light source; and control circuitry configured to update the control signal on a frame-by-frame basis using the image signal and a determination of a mode of change in the light emission luminance, the mode of change being a dynamic image mode or a static image mode, the dynamic image mode having a first rate of change of control signal updates that is lower than a second rate of change of control signal updates for the static image mode, wherein the control signal is updated to provide an updated control signal value for a frame of the image signal by determining a calculated control signal value for the frame from the image signal and adjusting the control signal based upon the calculated control signal value and one of the first rate of change or the second rate of change depending upon the determination of the mode of change, such that the updated control signal value approaches a difference in the calculated control signal value more slowly in the dynamic image mode than for the static image mode, and wherein the control circuitry generates on the basis of the image signal a conversion coefficient corresponding to each pixel which has a limit value for conversion of luminance of said each pixel on the basis of a hue for said each pixel and by which the luminance of said each pixel is converted, raises a ratio of conversion coefficients by which the luminance is converted over the limit value to all conversion coefficients when a result of the determination of the mode of change is the dynamic image mode, and lowers the ratio when the result is the static image mode.

2. The display device according to claim 1, wherein the calculated control signal value is a PWM value for the frame that is determined from the image signal.

3. The display device according to claim 2, wherein:

the light source includes a plurality of light source elements; and each of the plurality of light source elements emits light according to a respective PWM value.

4. The display device according to claim 3, wherein:

the light source elements are respective light emitting diodes.

5. The display device according to claim 1, wherein:

the control circuitry updates the mode of change from the static image mode to the dynamic image mode once a number of instances of frames determined to have a dynamic image are equal to or greater than a predetermined threshold.

6. The display device according to claim 1, wherein:

the control circuitry updates the mode of change from the dynamic image mode to the static image mode once a number of instances of frames determined to have a static image are equal to or greater than a predetermined threshold.

7. The display device according to claim 1, wherein the updated control signal value approaches the difference in the calculated control signal value more quickly in the static image mode than for the dynamic image mode.

8. A method for driving a display device that includes an image display panel, a light source, and a controller, the method comprising:

displaying an image on the basis of an image signal by the image display panel;

emitting, by the light source, light to the image display panel section by a dimming control according to a control signal that determines a light emission luminance of the light source; and updating, by the controller, the control signal on a frame-by-frame basis using the image signal and a determination of a mode of change in the light emission luminance, the mode of change being a dynamic image mode or a static image mode, the dynamic image mode having a first rate of change of control signal updates that is lower than a second rate of change of control signal updates for the static image mode, wherein the control signal is updated to provide an updated control signal value for a frame of the image signal by determining a calculated control signal value for the frame from the image signal and adjusting the control signal based upon the calculated control signal value and one of the first rate of change or the second rate of change depending upon the determination of the mode of change, such that the updated control signal value approaches a difference in the calculated control signal value more slowly in the dynamic image mode than for the static image mode, and wherein the controller generates on the basis of the image signal a conversion coefficient corresponding to each pixel which has a limit value for conversion of luminance of said each pixel on the basis of a hue for said each pixel and by which the luminance of said each pixel is converted, raises a ratio of conversion coefficients by which the luminance is converted over the limit value to all conversion coefficients when a result of the determination of the mode of change is the dynamic image mode, and lowers the ratio when the result is the static image mode.

* * * * *